US007353735B2

(12) United States Patent
Patel et al.

(10) Patent No.: US 7,353,735 B2
(45) Date of Patent: Apr. 8, 2008

(54) RATCHET WRENCH

(75) Inventors: Amit Patel, Lewisville, TX (US); Glenn Redding, Flower Mound, TX (US)

(73) Assignee: The Stanley Works, New Britain, CT (US)

( * ) Notice: Subject to any disclaimer, the term of this patent is extended or adjusted under 35 U.S.C. 154(b) by 120 days.

(21) Appl. No.: 11/142,469

(22) Filed: Jun. 2, 2005

(65) Prior Publication Data

US 2006/0272455 A1 Dec. 7, 2006

(51) Int. Cl.
*B25B 13/46* (2006.01)

(52) U.S. Cl. ..... 81/63; 81/60; 81/61; 81/62; 81/63.1; 81/63.2

(58) Field of Classification Search ..... None
See application file for complete search history.

(56) References Cited

U.S. PATENT DOCUMENTS

| | | | |
|---|---|---|---|
| 207,117 | A | 8/1878 | Hammond |
| 1,029,271 | A | 6/1912 | Bosserman |
| 1,199,157 | A | 9/1916 | Christine |
| 1,203,685 | A | 11/1916 | Baker |
| 1,426,127 | A | 8/1922 | Tuttle |
| 1,447,564 | A | 3/1923 | Norlund et al. |
| 1,453,607 | A | 5/1923 | Saucier |
| 1,868,840 | A | 7/1932 | McNaught et al. |
| 1,883,618 | A | 10/1932 | Dodge |
| 2,193,984 | A | 3/1940 | Rhinevault |
| 2,294,510 | A | 9/1942 | Nakano |
| 2,317,461 | A | 4/1943 | Jackson |
| 2,570,779 | A | 10/1951 | Dodge et al. |
| 2,653,500 | A | 9/1953 | Dyer |
| 2,803,980 | A | 8/1957 | Vogel |

(Continued)

FOREIGN PATENT DOCUMENTS

| | | | |
|---|---|---|---|
| DE | 3322-967 | A | 1/1985 |

(Continued)

OTHER PUBLICATIONS

Internet Publication MaTwEB "Shore (Durometer) Hardness Testing of Plastics" http://www.matweb.com/reference/shore-hardness.asp.*

*Primary Examiner*—Joseph J. Hail, III
*Assistant Examiner*—Bryan R. Muller
(74) *Attorney, Agent, or Firm*—Pillsbury Winthrop Shaw Pittman LLP

(57) ABSTRACT

A ratchet wrench includes a body with a head portion and a shaft. The head portion includes a cavity. A rotatable member is received by the cavity and is rotatable about an axis. The rotatable member has a plurality of teeth disposed around a circumferential surface thereof. A reversing member is pivotally mounted to the body, and is movable between a first position and a second position. A pawl is connected to the reversing member such that the pawl moves circumferentially relative to the axis of the rotatable member as the reversing member moves between the first and second positions. The pawl includes a plurality of teeth that intermesh with the plurality of teeth on the rotatable member. Substantially all of the teeth of the pawl remain intermeshed with the teeth of the rotatable member as the reversing member moves between the first position and the second position.

14 Claims, 9 Drawing Sheets

U.S. PATENT DOCUMENTS

| | | | | |
|---|---|---|---|---|
| 2,869,410 | A | | 1/1959 | Prichard |
| 2,943,523 | A | | 7/1960 | Gray et al. |
| 2,978,081 | A | | 4/1961 | Lundin |
| 3,019,682 | A | | 2/1962 | Hare |
| 3,145,594 | A | | 8/1964 | Peters |
| 3,186,265 | A | | 6/1965 | Wenturine et al. |
| 3,265,171 | A | | 8/1966 | Kilness |
| 3,269,496 | A | | 8/1966 | Kilness |
| 3,299,725 | A | | 1/1967 | Gewirc et al. |
| 3,349,653 | A | | 10/1967 | Kaufman et al. |
| 3,369,416 | A | | 2/1968 | Kilness |
| 3,436,992 | A | | 4/1969 | Over et al. |
| 3,467,231 | A | | 9/1969 | Haznar |
| 3,532,012 | A | | 10/1970 | Pryor |
| 3,713,356 | A | | 1/1973 | Knudsen |
| 3,732,756 | A | | 5/1973 | Thomasian |
| 3,742,788 | A | | 7/1973 | Priest |
| 3,838,614 | A | | 10/1974 | O'Donnell |
| 3,877,328 | A | | 4/1975 | Sullivan |
| 4,053,037 | A | | 10/1977 | Solomon |
| 4,147,076 | A | | 4/1979 | Wright et al. |
| 4,259,883 | A | | 4/1981 | Carlson |
| 4,270,417 | A | | 6/1981 | Tesoro |
| 4,277,990 | A | | 7/1981 | Hall |
| 4,308,769 | A | | 1/1982 | Rantanen |
| 4,327,611 | A | | 5/1982 | Cantanese et al. |
| 4,328,720 | A | | 5/1982 | Shiel |
| 4,336,728 | A | | 6/1982 | Deibert |
| 4,420,995 | A | | 12/1983 | Roberts |
| 4,441,387 | A | | 4/1984 | Hendricks |
| 4,463,632 | A | | 8/1984 | Parke |
| 4,475,420 | A | | 10/1984 | Atkinson et al. |
| 4,485,700 | A | | 12/1984 | Colvin |
| 4,491,043 | A | | 1/1985 | Dempsey et al. |
| 4,497,227 | A | | 2/1985 | Stasiek |
| 4,507,990 | A | | 4/1985 | Lack |
| 4,515,044 | A | | 5/1985 | Harstad |
| 4,520,697 | A | | 6/1985 | Moetteli |
| 4,592,255 | A | | 6/1986 | Mayer |
| 4,602,534 | A | | 7/1986 | Moetteli |
| 4,622,870 | A | | 11/1986 | Shirley |
| 4,631,988 | A | | 12/1986 | Colvin |
| 4,762,033 | A | | 8/1988 | Chow |
| 4,796,492 | A | * | 1/1989 | Liou ..... 81/58 |
| 4,817,475 | A | | 4/1989 | Kelly et al. |
| 4,817,476 | A | | 4/1989 | Karge |
| 4,862,775 | A | | 9/1989 | Chow |
| 4,873,898 | A | | 10/1989 | Chern |
| 4,903,554 | A | | 2/1990 | Colvin |
| 4,907,476 | A | | 3/1990 | Singleton |
| 4,934,220 | A | * | 6/1990 | Slusar et al. ..... 81/63.2 |
| 4,991,468 | A | | 2/1991 | Lee |
| 4,991,470 | A | | 2/1991 | Singleton |
| 4,993,288 | A | | 2/1991 | Anderson et al. |
| 5,007,311 | A | | 4/1991 | Lee |
| 5,058,463 | A | | 10/1991 | Wannop |
| D322,203 | S | | 12/1991 | Kanyuck, Sr. |
| 5,076,121 | A | | 12/1991 | Fosella |
| 5,090,273 | A | | 2/1992 | Fosella |
| 5,094,490 | A | | 3/1992 | Shirey |
| 5,157,994 | A | * | 10/1992 | Krivec ..... 81/63.2 |
| 5,178,047 | A | | 1/1993 | Arnold et al. |
| 5,199,330 | A | | 4/1993 | Arnold et al. |
| 5,207,129 | A | | 5/1993 | Fossella |
| 5,218,891 | A | | 6/1993 | Olson et al. |
| 5,230,262 | A | | 7/1993 | Ahlund et al. |
| 5,230,263 | A | | 7/1993 | Kwaka |
| 5,231,903 | A | | 8/1993 | Bockman, Jr. |
| 5,259,276 | A | | 11/1993 | Baron |
| 5,269,207 | A | | 12/1993 | Kutzler |
| 5,280,740 | A | | 1/1994 | Ernst |
| 5,325,743 | A | | 7/1994 | Engel |
| 5,331,869 | A | | 7/1994 | Webb |
| 5,386,747 | A | | 2/1995 | Grover |
| 5,392,672 | A | | 2/1995 | Larson et al. |
| 5,448,931 | A | | 9/1995 | Fossella et al. |
| 5,454,283 | A | | 10/1995 | Stefano |
| 5,477,757 | A | | 12/1995 | Maresh |
| 5,499,560 | A | | 3/1996 | Aeschliman |
| 5,522,288 | A | | 6/1996 | Slusar et al. |
| 5,533,427 | A | | 7/1996 | Chow |
| 5,557,994 | A | | 9/1996 | Nakayama |
| 5,595,095 | A | | 1/1997 | Hillinger |
| 5,626,062 | A | | 5/1997 | Colvin |
| 5,636,557 | A | | 6/1997 | Ma |
| 5,694,818 | A | | 12/1997 | Nickipuck |
| 5,713,251 | A | | 2/1998 | Zurbuchen et al. |
| 5,738,192 | A | | 4/1998 | Miner |
| 5,782,147 | A | | 7/1998 | Chaconas et al. |
| 5,794,496 | A | | 8/1998 | Arnold |
| D397,597 | S | | 9/1998 | Davidson et al. |
| 5,857,390 | A | | 1/1999 | Whiteford |
| 5,862,723 | A | | 1/1999 | Rowlands |
| 5,870,932 | A | | 2/1999 | Brooke |
| 5,878,635 | A | | 3/1999 | Hsieh |
| 5,893,306 | A | | 4/1999 | Owoc |
| 5,901,620 | A | | 5/1999 | Arnold |
| 5,913,954 | A | | 6/1999 | Arnold et al. |
| 5,921,158 | A | | 7/1999 | Slusar et al. |
| 5,927,158 | A | | 7/1999 | Lin |
| 5,941,141 | A | | 8/1999 | Whitley |
| 5,946,987 | A | | 9/1999 | Wei |
| 5,953,966 | A | | 9/1999 | Spirer |
| 5,957,008 | A | | 9/1999 | Long |
| 5,957,009 | A | | 9/1999 | McCann |
| 5,960,680 | A | | 10/1999 | Chen et al. |
| 5,964,129 | A | | 10/1999 | Shiao |
| 5,974,915 | A | | 11/1999 | Chow |
| 5,979,274 | A | | 11/1999 | Hsieh |
| 5,996,453 | A | | 12/1999 | Blacklock |
| 6,000,302 | A | | 12/1999 | Chiang |
| 6,044,730 | A | | 4/2000 | Roberts et al. |
| D423,891 | S | | 5/2000 | Melvin et al. |
| 6,109,140 | A | | 8/2000 | Roberts et al. |
| 6,109,141 | A | * | 8/2000 | Nurmi ..... 81/63 |
| 6,125,722 | A | * | 10/2000 | Hopper et al. ..... 81/63 |
| 6,161,754 | A | | 12/2000 | Chaconas |
| 6,164,166 | A | | 12/2000 | Whiteford |
| 6,164,167 | A | | 12/2000 | Chen |
| D438,438 | S | | 3/2001 | Melvin et al. |
| D439,121 | S | | 3/2001 | Hsu |
| D439,480 | S | | 3/2001 | Hsu |
| 6,205,890 | B1 | | 3/2001 | Roberts et al. |
| 6,257,097 | B1 | | 7/2001 | I-He |
| 6,260,448 | B1 | | 7/2001 | Chaconas |
| 6,260,449 | B1 | * | 7/2001 | I-He ..... 81/63.2 |
| 6,263,768 | B1 | | 7/2001 | Huang et al. |
| 6,282,991 | B1 | | 9/2001 | Hu |
| 6,282,992 | B1 | | 9/2001 | Hu |
| 6,282,993 | B1 | | 9/2001 | Forman et al. |
| 6,301,999 | B1 | | 10/2001 | Garg |
| 6,311,584 | B1 | | 11/2001 | Chu |
| 6,382,052 | B1 | | 5/2002 | Chen |
| 6,398,352 | B1 | * | 6/2002 | Morita ..... 347/86 |
| 6,435,062 | B1 | | 8/2002 | McCann |
| 6,457,388 | B1 | * | 10/2002 | Chen ..... 81/63.2 |
| 6,490,953 | B2 | | 12/2002 | Horvath |
| 6,513,409 | B1 | * | 2/2003 | Lee ..... 81/63 |
| 6,516,690 | B2 | | 2/2003 | Chen |
| D472,115 | S | | 3/2003 | Davidson et al. |
| 6,543,316 | B2 | | 4/2003 | Daigle et al. |
| D474,381 | S | | 5/2003 | Lee et al. |
| 6,584,875 | B1 | | 7/2003 | Deng |
| 6,629,477 | B2 | | 10/2003 | Ling et al. |

| | | | | |
|---|---|---|---|---|
| D484,374 | S | 12/2003 | Lee et al. | |
| 6,655,237 | B2 | 12/2003 | Chen | |
| 6,662,687 | B2 | 12/2003 | Garg | |
| 6,711,973 | B2 * | 3/2004 | Arnold et al. | 81/63.2 |
| 2002/0005093 | A1 | 1/2002 | Daigle et al. | |
| 2002/0096021 | A1 | 7/2002 | Wei | |
| 2002/0194965 | A1 * | 12/2002 | Chen | 81/63 |
| 2003/0037642 | A1 | 2/2003 | Liu | |
| 2003/0136230 | A1 | 7/2003 | Chen | |
| 2003/0154826 | A1 | 8/2003 | Lee | |
| 2003/0177872 | A1 * | 9/2003 | Shu-Ying et al. | 81/63.2 |
| 2003/0192408 | A1 | 10/2003 | Garg | |
| 2003/0221522 | A1 | 12/2003 | Wu | |
| 2003/0230173 | A1 | 12/2003 | Chen | |
| 2004/0025645 | A1 * | 2/2004 | Shu-Ying et al. | 81/63 |
| 2004/0035257 | A1 | 2/2004 | Tuan-Mu | |
| 2004/0045829 | A1 * | 3/2004 | Ingenhoven et al. | 204/465 |
| 2004/0083860 | A1 * | 5/2004 | Arnold et al. | 81/63.2 |
| 2004/0200322 | A1 | 10/2004 | Hu | |

FOREIGN PATENT DOCUMENTS

| | | |
|---|---|---|
| DE | 3406 063 A | 8/1985 |
| DE | 298 08 840 | 9/1998 |
| DK | 87890 | 12/1959 |
| FR | 1191282 | 10/1959 |
| FR | 1538615 A | 9/1968 |
| GB | 613 698 | 12/1948 |
| GB | 2 168 634 | 6/1986 |
| NO | 93743 | 4/1959 |
| TW | 141504 | 7/1998 |

* cited by examiner

RATCHET WRENCH

BACKGROUND OF THE INVENTION

1. Field of the Invention

The present invention relates generally to ratchet wrenches.

2. Description of Related Art

Ratchet wrenches in the art cover a variety of designs and sizes for a variety of uses. A typical ratchet wrench includes a rotatable member within the wrench that provides the desired torque to a nut when a user of the wrench tightens the nut, yet is rotatable relative to the rest of the wrench, i.e. in a ratcheting action, in the opposite direction so that the user does not have to rotate the entire wrench about the axis of rotation of the nut. The typical ratchet wrench also includes a reversing member that allows the direction of rotatability of the rotatable member relative to the rest of the wrench to be reversed, so that the wrench may then be used to loosen the nut, yet still be able to ratchet. The ratcheting action of a ratchet wrench is particularly useful in tight spaces, where there is little room for rotation of the entire wrench.

For larger wrenches in particular, because higher torques may be applied to a nut, the level of stresses seen in the internal parts of the wrench may be quite large. Thus, the interaction of the internal parts and the stress distribution within the internal parts become increasingly important as the torque increases.

In addition, because ratchet wrenches tend to be used in dirty environments, protecting the internal parts of the wrench from dirt and moisture is desirable, yet it is also desirable to have a relatively simple way to assemble the wrench, while providing adequate seals.

BRIEF SUMMARY OF THE INVENTION

It is one aspect of the present invention to provide a ratchet wrench that includes a body with a head portion and a shaft extending from the head portion. The head portion includes a cavity. A rotatable member is received by the cavity of the head portion and is rotatable about an axis. The rotatable member has a plurality of teeth disposed around a circumferential surface thereof, and a socket engaging portion. A reversing member is pivotally mounted to the body. The reversing member is movable between a first position and a second position. The wrench also includes a pawl connected to the reversing member such that the pawl moves circumferentially relative to the axis of the rotatable member as the reversing member moves between the first and second positions. The pawl includes a plurality of teeth that are constructed and arranged to intermesh with the plurality of teeth on the rotatable member. The pawl is constructed and arranged to (1) prevent the rotatable member from rotating relative to the body in a first direction when the reversing member is located in the first position, and (2) prevent the rotatable member from rotating relative to the body in a second direction that is opposite the first direction when the reversing member is located in the second position. Substantially all of the teeth of the pawl remain intermeshed with the teeth of the rotatable member as the reversing member moves between the first position and the second position.

Another aspect of the present invention is to provide a ratchet wrench that includes a body with a head portion and a shaft extending from the head portion, the head portion comprising a cavity. A rotatable member is received by the cavity of the head portion and is rotatable about an axis. The rotatable member has a plurality of teeth disposed around a circumferential surface thereof, and a socket engaging portion. A reversing member is pivotally mounted to the body and is movable between a first position and a second position. A pawl is connected to the reversing member and the rotatable member. The pawl includes a plurality of teeth that are constructed and arranged to intermesh with the plurality of teeth on the rotatable member. The pawl is constructed and arranged to (1) prevent the rotatable member from rotating relative to the body in a first direction when the reversing mechanism is located in the first position, and (2) prevent the rotatable member from rotating relative to the body in a second direction that is opposite the first direction when the reversing mechanism is located in the second position. The wrench also includes a cover for covering the cavity. The cover has a plate with an opening for allowing the rotatable member to be connected with a socket at the socket engaging portion, and a seal that is integrally attached to the plate so as to form a single integral piece.

Another aspect of the invention provides a method for assembling a ratchet wrench. The method includes inserting a portion of a reversing member into a cavity of a head portion of a body of the ratchet wrench. The reversing member includes a protrusion receiving space. The method also includes connecting a pawl to the reversing member by placing a protrusion of the pawl in the protrusion receiving space, intermeshing a plurality of teeth of a rotatable member with a plurality of teeth of the pawl, and inserting at least a portion of the rotatable member into the cavity. The method further includes providing a cover having an integral seal and an opening for allowing the rotatable member to connect with a socket, and mounting the cover to the head portion to close the cavity and seal the cover with the head portion.

Other objects, features, and advantages of the present invention will become apparent from the following detailed description, the accompanying drawings, and the appended claims.

BRIEF DESCRIPTION OF THE DRAWINGS

Features of the invention are shown in the drawings, in which like reference numerals designate like elements. The drawings form part of this original disclosure, in which.

DETAILED DESCRIPTION OF THE INVENTION

Figure 1:
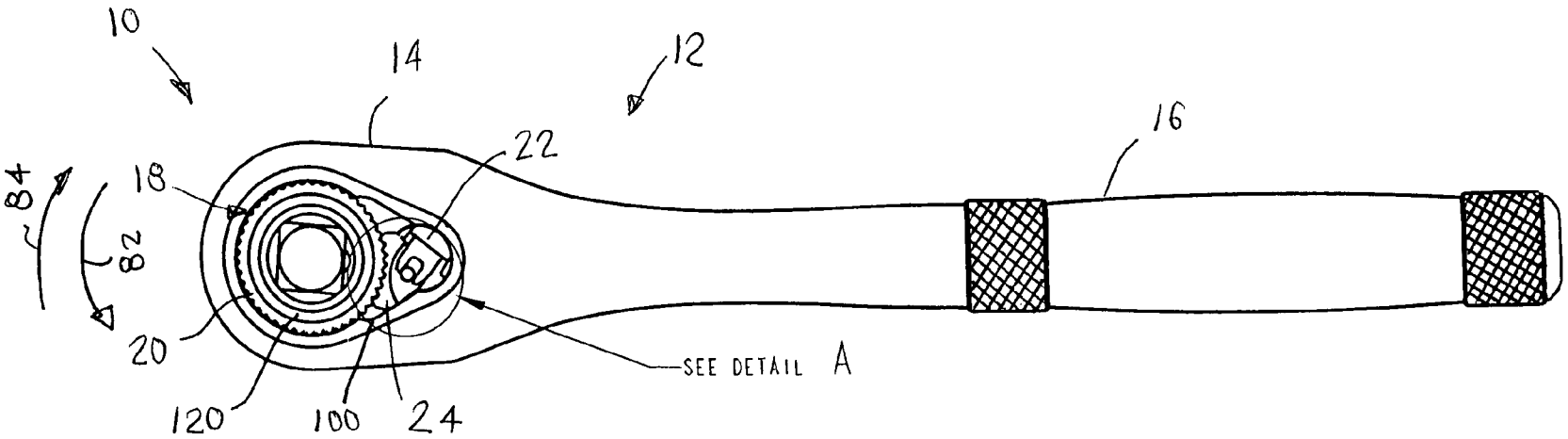
FIG. 1 shows a front view of a ratchet wrench of the present invention with a cover removed.
Figure 2:
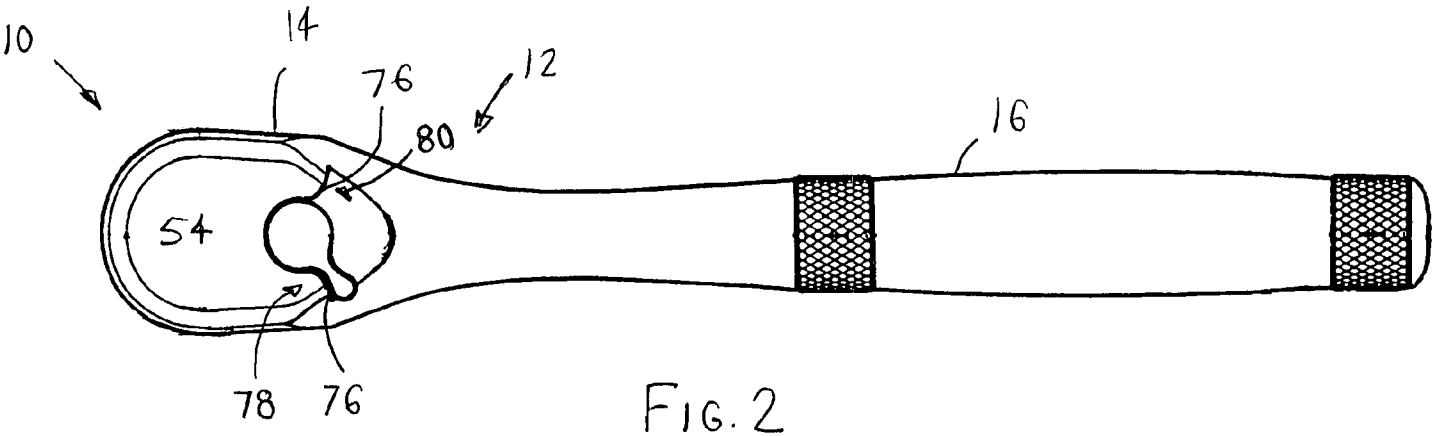
FIG. 2 shows a back view of the ratchet wrench of FIG. 1.

FIGS. 1 and 2 show an embodiment of a ratchet wrench 10 of the present invention. The ratchet wrench 10 includes a body 12, which includes a head portion 14 and a handle portion 16 that extends from the head portion 14. The handle portion 16 is configured to be grasped by a user of the wrench 10. As shown in FIG. 1, the head portion 14 includes a cavity 18 on one side thereof. The cavity 18 contains the inner workings of the ratchet wrench 10, as will be described in detail below.

As shown in FIG. 1, the wrench 10 also includes a rotatable member 20, a reversing member 22, and a pawl 24 that is disposed between the rotatable member 20 and the reversing member 22. Upon assembly, at least a portion of the rotatable member 20 is contained within the cavity 18, and a portion of the reversing member 22 is contained within the cavity 18, while the pawl 24 is completely contained within the cavity 18. As will be discussed in further detail below, the rotatable member 20, the reversing member 22, and the pawl 24 interact with one another to provide a wrench that allows the rotatable member 20 to rotate in only one direction, depending on the position of the reversing member 22.

Figure 5:
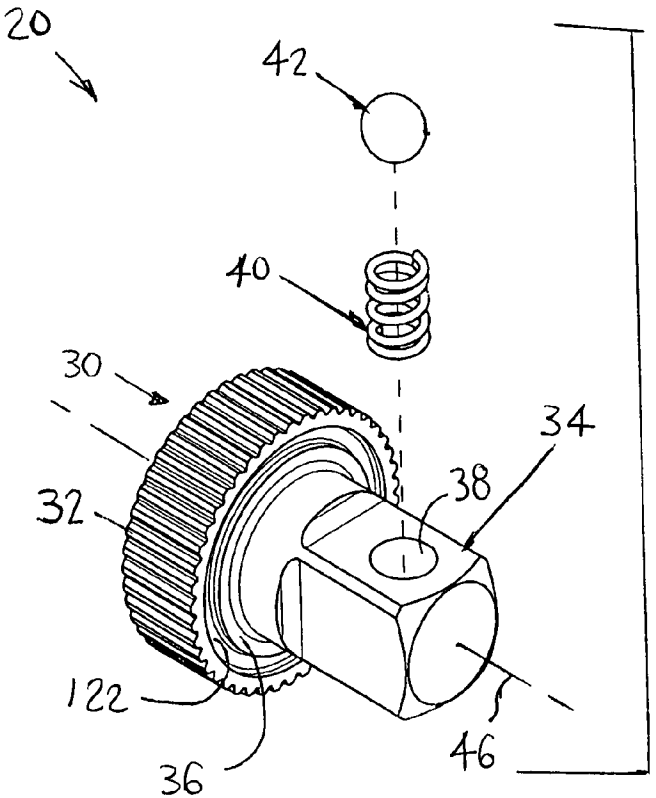
FIG. 5 shows an exploded view of rotatable member of the ratchet wrench of FIG. 1

FIG. 5 shows the rotatable member 20 in more detail. The rotatable member 20 includes a plurality of teeth 30 disposed around a circumferential surface thereof. As illustrated, each tooth 30 optionally includes a substantially flat portion 32 at its tip, i.e., each tooth 30 does not form a sharp point at its tip. In the illustrated embodiment, the rotatable member 22 is rotatable about an axis 46, and includes a socket engaging portion 34 that extends away from a front face 36 of the rotatable member 20 along the axis 46. The socket engaging portion 34 is substantially square in cross section and may be sized to receive ⅜", ½", metric, or any other type of socket. The socket engaging portion 34, however, may have any shape or configuration. For example, the socket engaging portion 34 may not extend from the front face 36 of the rotatable member 20, but may instead have a socket receiving opening or recess that is substantially contained within the cavity 18 for receiving a protrusion located on the socket, as would be appreciated by one of ordinary skill in the art. The illustrated embodiment is not intended to be limiting in any way.

The socket engaging portion 34 illustrated includes a cylindrical recess 38 for receiving a spring 40 and a ball 42. The cylindrical recess 38, the spring 40, and the ball 42 are configured so that the spring 40 and a portion of the ball 42 are held within the cylindrical recess 34, while the spring 40 biases another portion of the ball 42 outward from the cylindrical recess 34. This allows the ball 42 to be substantially pushed into the cylindrical recess 40 when a socket is being attached to the socket engaging portion 34, yet still apply pressure on the socket so that the socket stays attached to the socket engaging portion 34. To remove the socket, the user simply pulls the socket away from the front face 36 of the rotatable member 20. The ball 42 is allowed to rotate, thereby making movement of the socket easier for the user. Of course, other arrangements may be used to hold the socket onto the socket engaging portion 34, and the illustrated embodiment should not be considered to be limiting in any way.

Figure 3A:
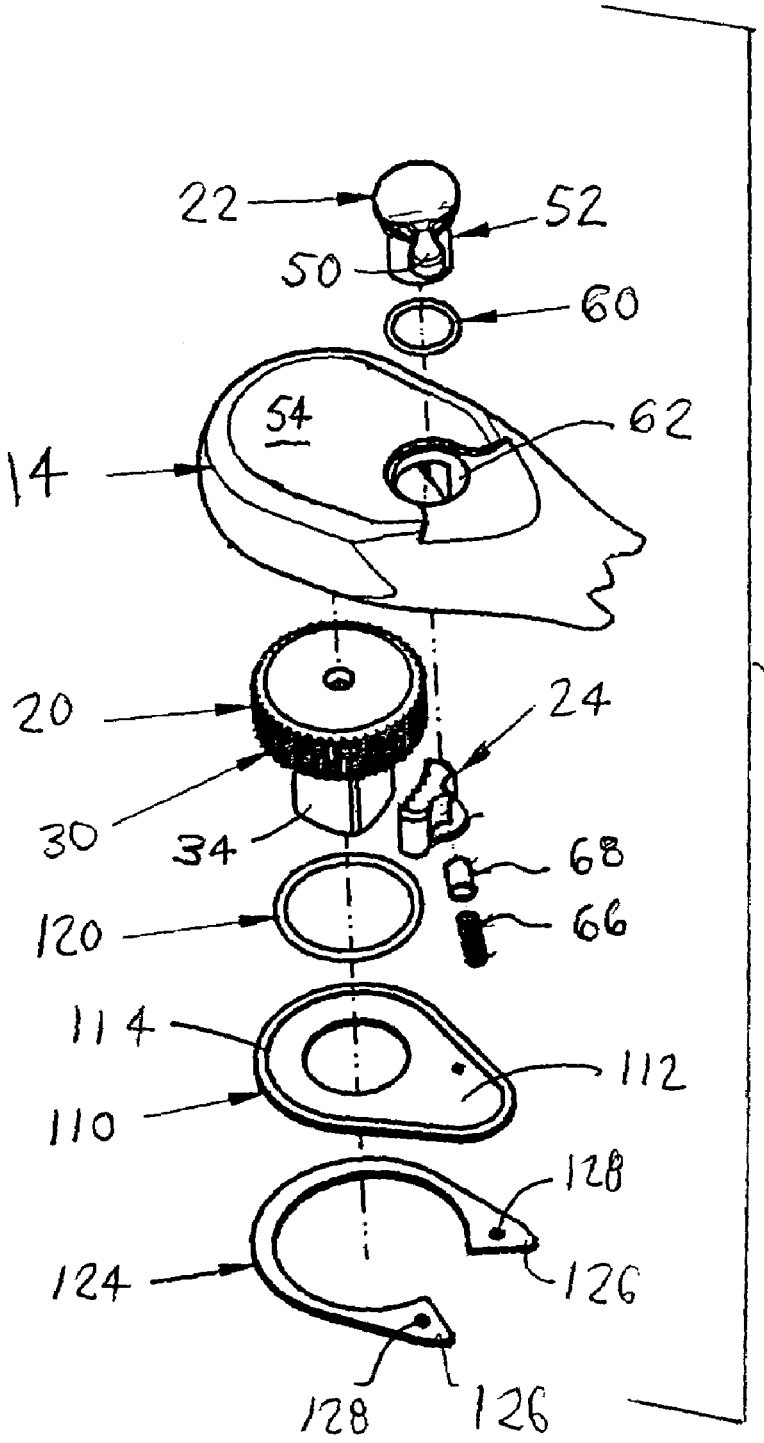
FIG. 3*a* shows an exploded view of a head portion of the ratchet wrench of FIGS. 1 and 2 with a cover.
Figure 3B:
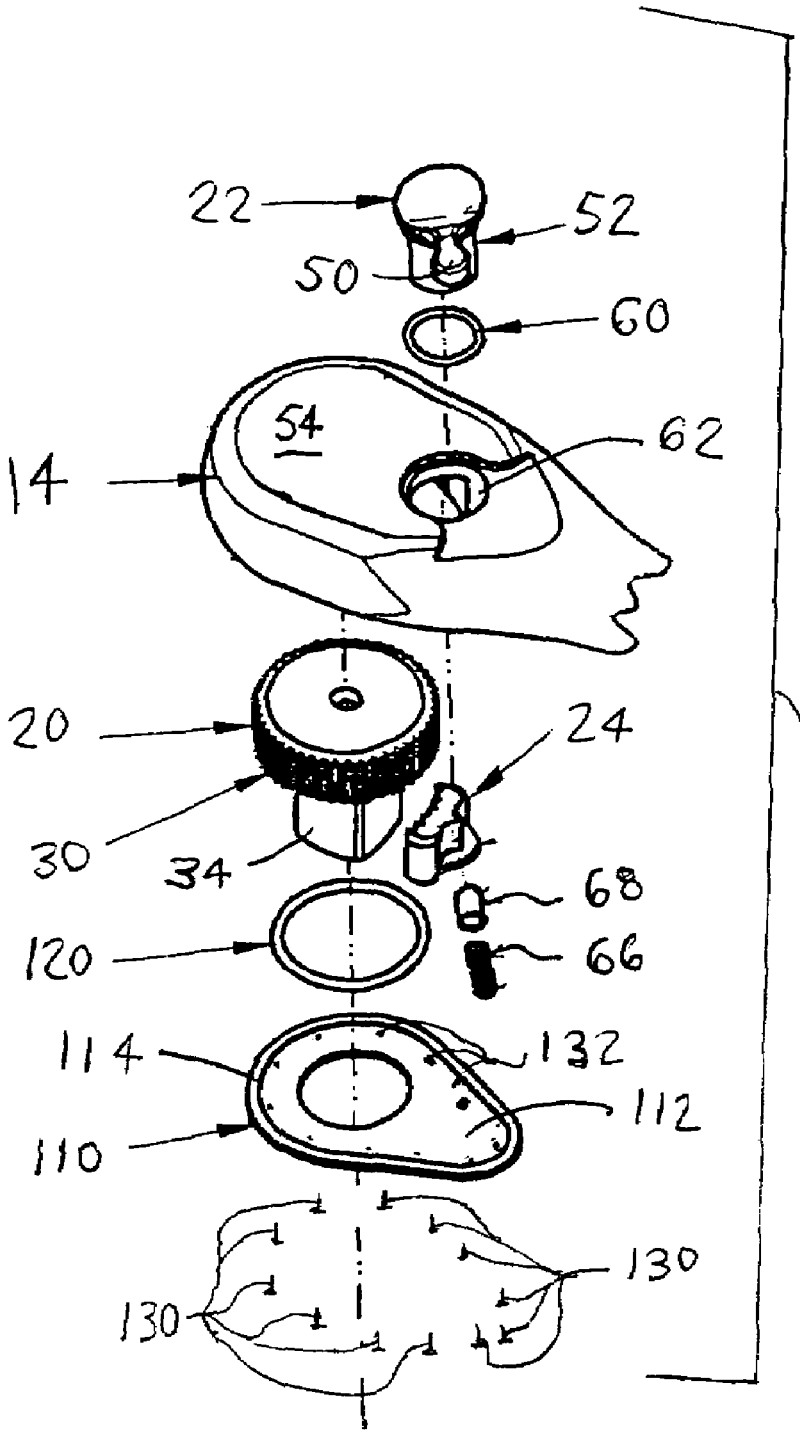
FIG. 3*b* shows an exploded view of another embodiment of the head portion of the ratchet wrench of FIG. 3*a;*
Figure 7:
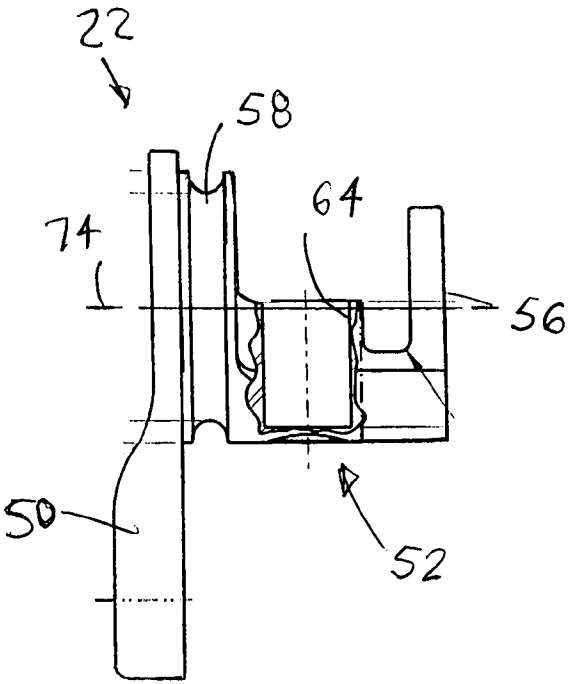
FIG. 7 shows a side view of the reversing member of FIG. 6.
Figure 6:
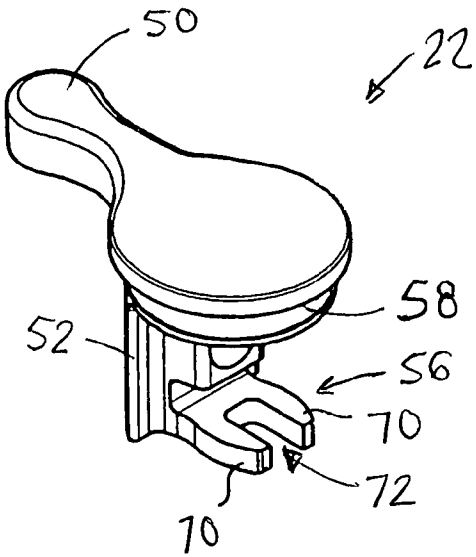
FIG. 6 shows a detailed perspective view of a reversing member of the ratchet wrench of FIG. 1.
Figure 12:
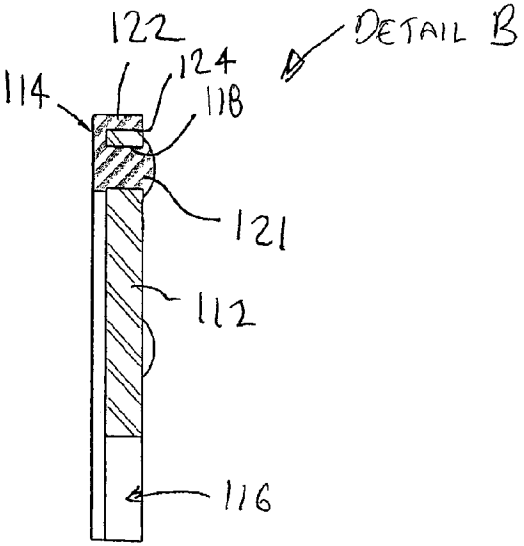
FIG. 12 shows detail B of FIG. 11.
Figure 13:
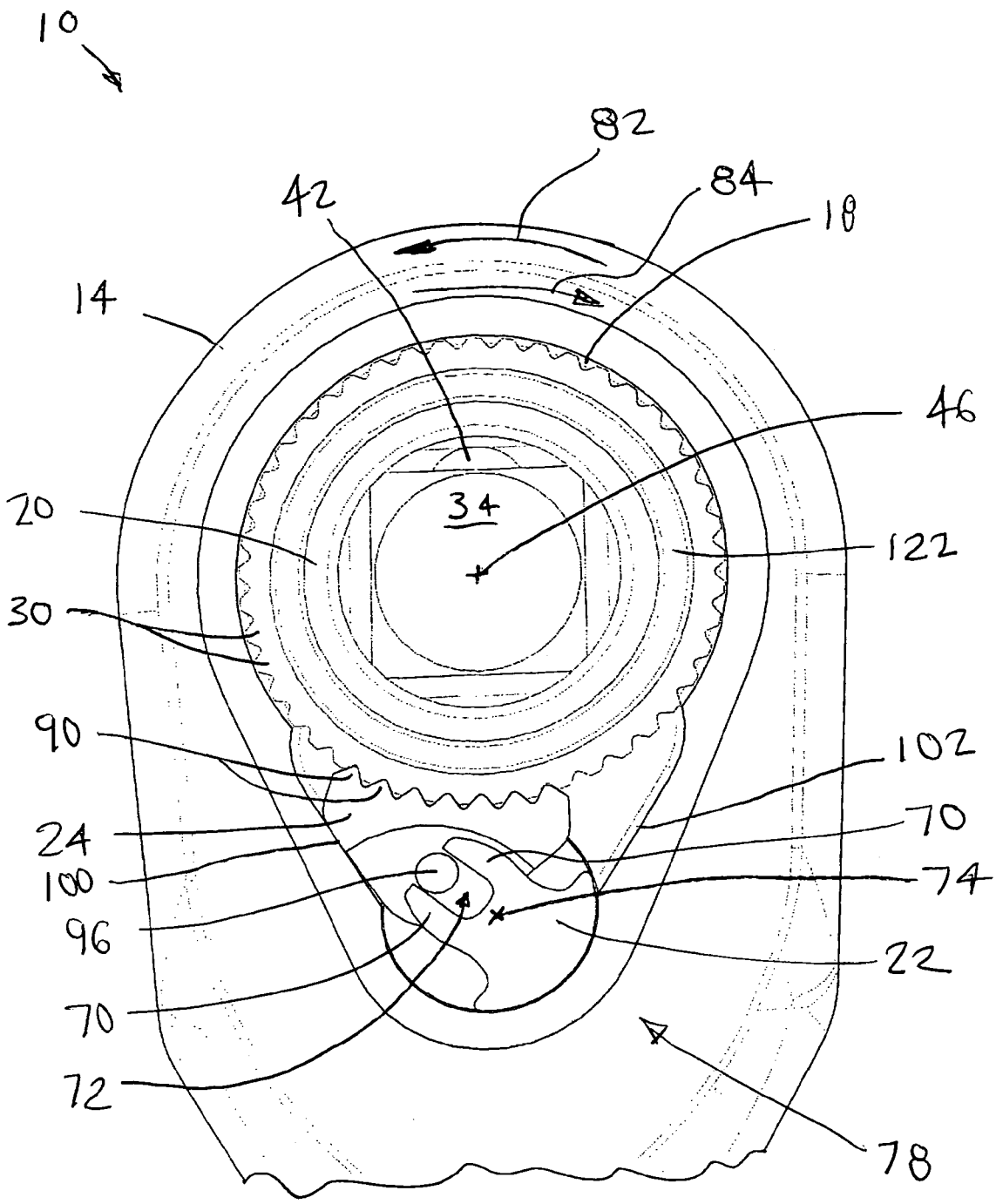
FIG. 13 shows the head portion of the ratchet wrench with the reversing member in a first position.
Figure 14:
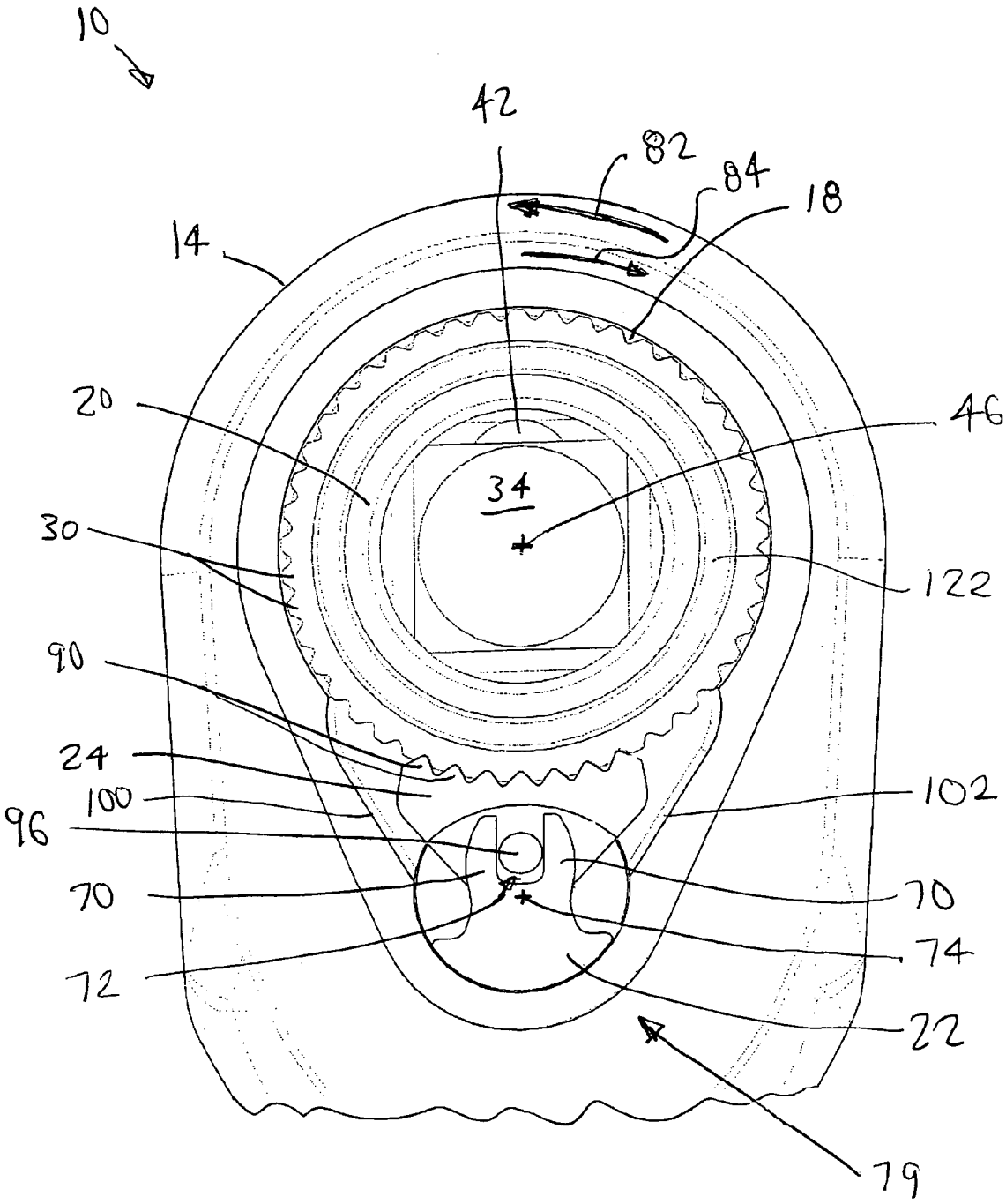
FIG. 14 shows the head portion of the ratchet wrench with the reversing member in a neutral position.
Figure 15:
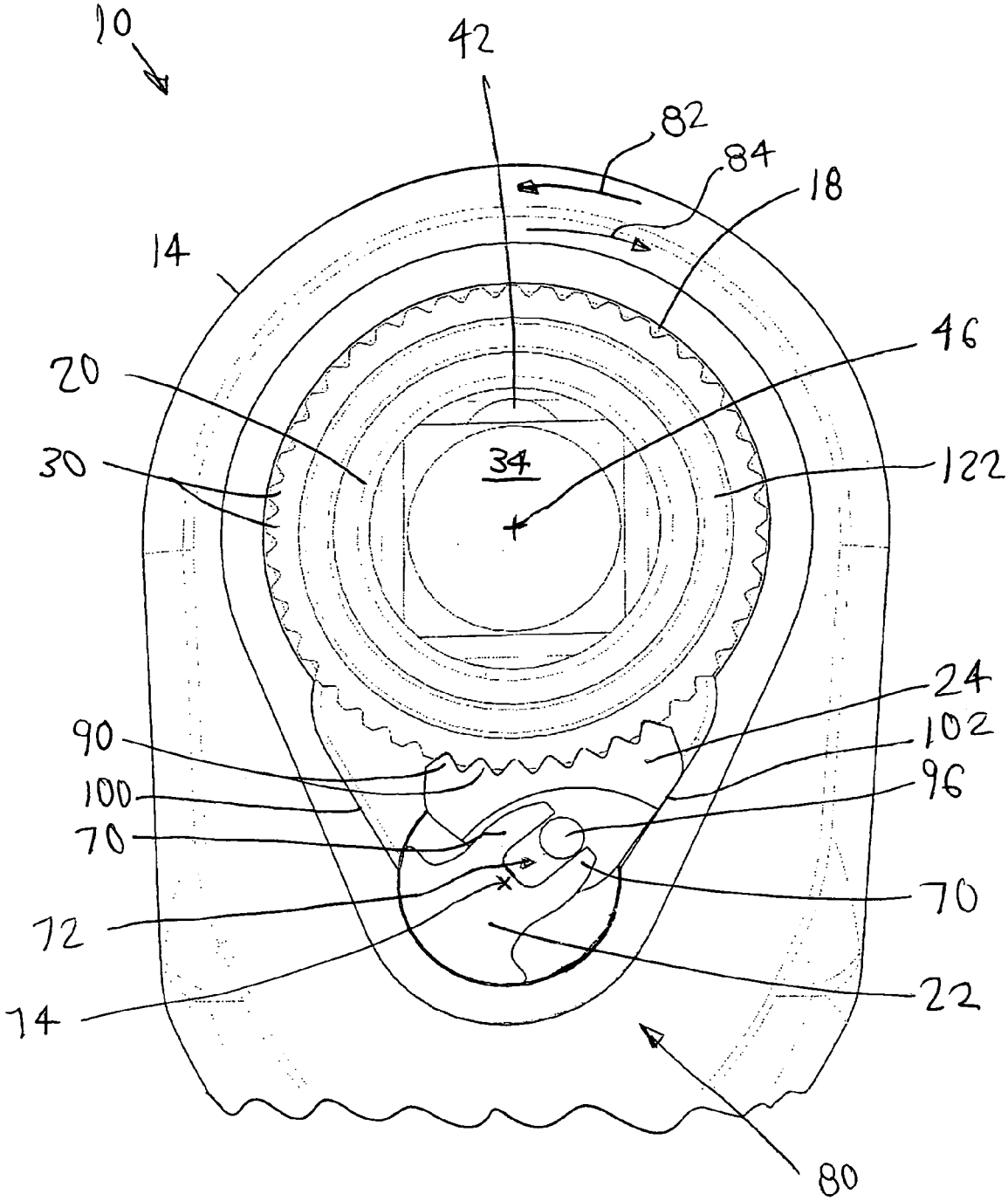
FIG. 15 shows the head portion of the ratchet wrench with the reversing member is a second position.

As shown in FIGS. 3*a* and 3*b*, a body portion 52 of the reversing member 22 is inserted into the cavity 18 from a back side 54 of the head portion 14. The reversing member 22 is shown in greater detail in FIGS. 6 and 7. As shown in the figures, the reversing member 22 includes a lever 50 on one side of the body portion 52, and a fork 56 on an opposite side of the body portion 52. The lever 50 is designed to stay on the outside of the cavity so that it may be manually pivoted by the user of the wrench 10, as will be discussed in further detail below. As shown in FIG. 6, the body portion 52 includes a circumferential groove 58 that is configured to receive an annular o-ring 60 (shown in FIGS. 3*a* and 3*b*). The o-ring 60 seals an opening 62 in the back side 54 of the head portion 14 that receives the reversing member 22. The body portion 52 also includes a cylindrical recess 64 that is configured to receive a spring 66 and a plunger 68. The plunger 68 is configured to fit over the spring 66 and into the cylindrical recess 64. The spring 66 biases the plunger 68 away from the cylindrical recess 64, as will be discussed in further detail below. The fork 56 of the reversing member 22 is shown in greater detail in FIG. 6. As shown, the fork 56 includes a pair of tines 70 and a protrusion receiving space 72 between the tines 70. The length of the tines 70 and the size of the protrusion receiving space 72 are designed to allow movement of the pawl 24 relative to the reversing member 22, as will be discussed in further detail below. The protrusion receiving space 72 is oriented somewhat circumferentially so that when the reversing member 22 pivots about an axis 74, the protrusion receiving space 72 gets reoriented relative to the axis 74, as can be seen in FIGS. 13-15. The orientation of the protrusion receiving space 72 generally tracks the circumference of the rotatable member 20.

As shown in FIG. 2, the back side 54 of the head portion 14 includes a pair of surfaces 76 that limit the pivoting motion of the lever 50. The surfaces 76 help to define a first position 78 of the reversing member 22 and a second position 80 of the reversing member 22. As will be discussed in further detail below, the first position 78 and the second position 80 of the reversing member 22 determine whether the rotatable member 20 may rotate in a first direction 82, e.g. counterclockwise, or in a second direction 84 that is opposite the first direction 82, e.g. clockwise, as shown in FIG. 2.

As shown in FIGS. 13-15, the pawl 24 is connected to the reversing member 22 so that the pawl 24 moves circumferentially to the axis 46 of the rotatable member 20 as the reversing member 22 moves between the first and second positions 78, 80. The pawl 24 includes a plurality of teeth 90 that are constructed and arranged to intermesh with the plurality of teeth 30 on the rotatable member 20. That is, the plurality of teeth 90 on the pawl 24 have substantially the same pitch as and are also positioned along the same curvature as the plurality of teeth 30 on the rotatable member 20, as shown in more detail in FIG. 4. This allows the pawl 24 to be fully intermeshed with the rotatable member 20 at all times, i.e., all of the teeth 90 of the pawl 24 are fully intermeshed with selected teeth 30 of the rotatable member 20 at all times. This improves the stress distribution within the teeth 30 of the rotatable member 20 and the teeth 90 of the pawl 24, when there is a load on the socket engaging portion 34 of the rotatable member 20.

Figure 4:
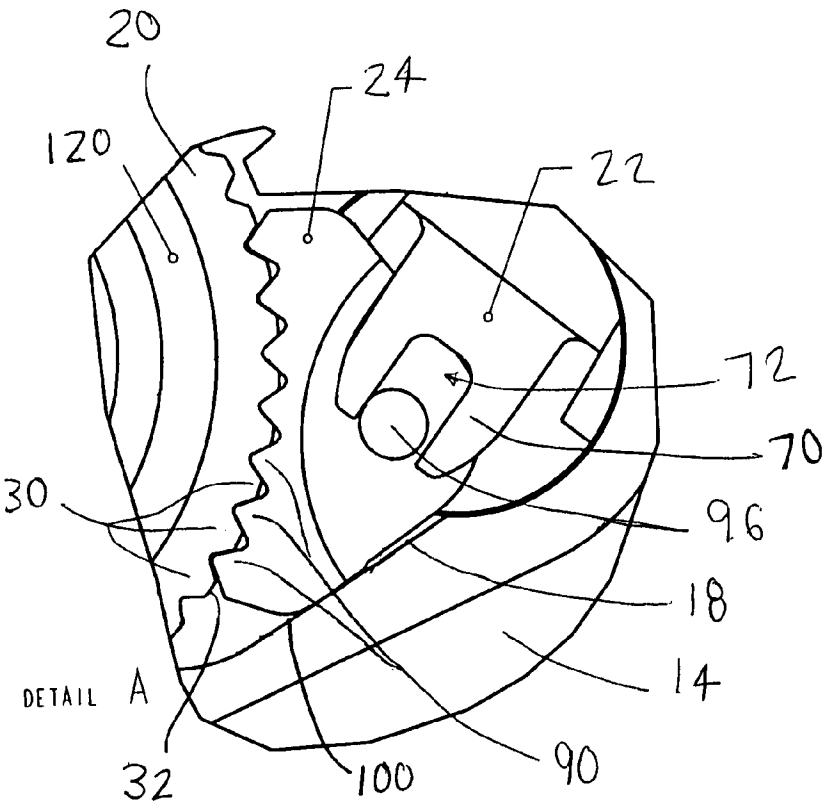
FIG. 4 shows detail A of FIG. 1.
Figure 8:
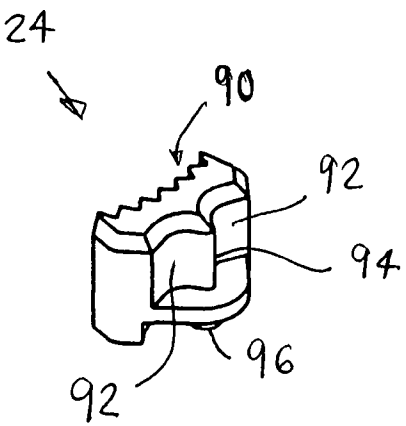
FIG. 8 shows a detailed perspective view of a pawl of the ratchet wrench of FIG. 1.

As shown in FIG. 8, the pawl 24 includes a cam surface 92 that includes an inflection point 94 at the center of the cam surface 92. This cam surface 92 interacts with the plunger 68, and spring 66, of the reversing member 22 as the reversing member 22 rotates. A protrusion 96 extends from a side of the pawl 24 that is opposite the cam surface 92, as is shown in FIG. 8. As shown in FIG. 4, the protrusion 96 is slidably received by the protrusion receiving space 72 between the tines 70 of the reversing member 22. A slight clearance is provided between the tines 70 so that the protrusion 96 may freely move within the protrusion receiving space 72, yet still be guided by the tines 70 upon movement of the reversing member 22.

As the reversing member 22 pivots about its axis 74, the biasing of the spring 66 allows the plunger 68 to follow the cam surface 92 of the pawl 24, while the protrusion 96 of the pawl 24 moves within the space 72 between the tines 70 such that the inner surfaces of the tines 70 act as cam surfaces for the protrusion 96. When the reversing member 22 is in a neutral position 79 that is substantially in the middle of the first position 78 and the second position 80, the plunger 68 is in contact with the inflection point 94 of the cam surface 92, and the protrusion 96 is substantially in the middle of the protrusion receiving space 72, as shown in FIG. 14. In this position, the rotatable member 20 is temporarily "locked" in position, i.e., the rotatable member cannot rotate in either the first direction 82 or the second direction 84. This is due to the symmetry of the pawl 24, and the alignment of the axis of rotation 46 of the rotating member 20, the inflection point 94 of the cam surface 92 of the pawl 24, the plunger 68, the spring 66, and the axis of rotation 74 of the reversing member 22.

When the reversing member 22 is moved to either the first position 78 or the second position 80, the position of the pawl 24 is shifted, and the inflection point 94, the plunger 68, and the spring 66 are no longer in alignment. For example, as shown in FIGS. 1, 4, and 13, when the reversing member 22 is in the first position 78, the pawl 24 is shifted to a position in which the pawl 24 abuts a first portion of a wall 100 of the cavity 18. This allows the pawl 24 to act as a wedge when the rotatable member 20 attempts to rotate in the second direction 84, such that the rotatable member 20 cannot rotate in the second direction 84, which allows the wrench 10 to be used to tighten a nut onto a bolt. The length of the handle 16, as well as the integrity of the rotatable member 20, the pawl 24, and the reversing member 22, determine how much torque may be transmitted to the nut.

Similarly, as shown in FIG. 15, when the reversing member 22 is moved to the second position 80, the protrusion 96 of the pawl 24 moves with the reversing member 22, thereby causing the pawl 24 to move until it abuts another portion 102 of the wall that is opposite from the first portion of the wall 100. This position of the pawl 24 prevents the rotation of the rotatable member 20 in the first direction 82, as the pawl 24 acts as a wedge to the rotatable member 20. However, the rotatable member 20 is able to rotate in the second direction 82.

The pawl 24 is designed so that all of the teeth 90 of the pawl 24 are in contact with teeth 30 on the rotatable member 20. This allows the force that is transmitted from the rotatable member 20 to the pawl 24 to be substantially evenly distributed, rather than having almost all of the force transmitted to a couple or a few teeth, as is done in many wrenches in the art. By allowing for substantially even distribution of the force across more teeth 90 on the pawl 24, greater forces, and hence torque, may be handled by the wrench 10, which allows for a more reliable and heavy-duty wrench 10, as would be appreciated by one of ordinary skill in the art.

When the reversing member 22 is in this first position 78, shown in FIG. 13, as discussed above, the design of the pawl 24 and the reversing member 22 allow the rotatable member 20 to rotate in the first direction 78, thereby creating a ratcheting action. Thus, as the user tightens a nut with the wrench 10, the user may ratchet the wrench 10 instead of fully rotating the handle 16 of the wrench about the axis 46 of the rotating member 46, as would be appreciated by one of ordinary skill in the art. To loosen a nut, the user simply moves the reversing member 22 through the neutral position 79, shown in FIG. 14, to the second position 80, shown in FIG. 15. Once in the second position 80, the user may use the wrench 10 to loosen the nut, as the rotatable member 20 will not rotate in the first direction 82 relative to body 12 of the wrench 10. Ratcheting action may be used, as the rotatable member 20 may ratchet relative to the pawl 24 in the second direction 84.

Figure 9:
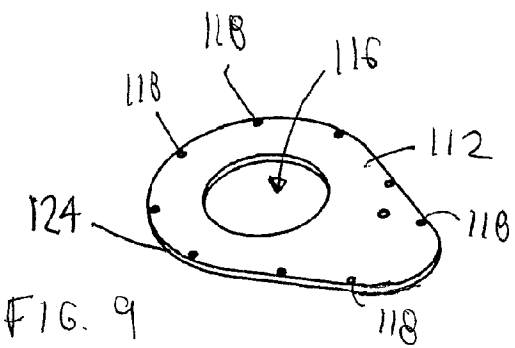
FIG. 9 shows a detailed perspective view of a plate of the cover of the ratchet wrench of FIG. 3*a* before an integral seal has been attached to the plate.
Figure 11:
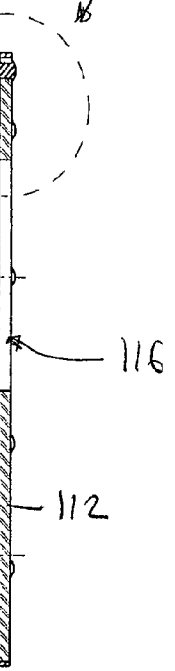
FIG. 11 is a cross-section view taken along line 11-11 in FIG. 10.
Figure 10:
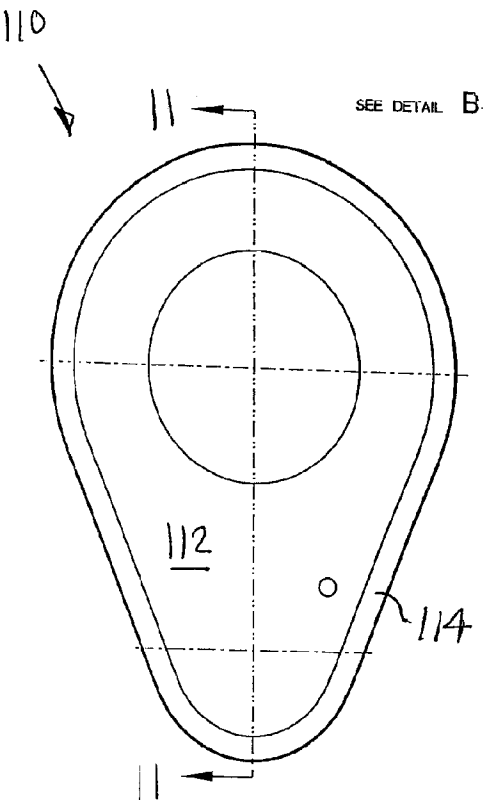
FIG. 10 shows a front view of the cover of FIG. 9 after the integral seal has been attached to the plate.

In the illustrated embodiments, the cavity 18 is covered by a cover 110. The cover 110 includes a plate 112 and a seal 114. The plate 112, which is shown in greater detail in FIG. 9, includes a large substantially centered opening 116. The opening 116 is sized to allow a connection between the rotatable member 20 and the socket at the socket engaging portion 34. In the illustrated embodiments, the opening 116 is sized to allow the socket engaging portion 34 of the rotatable member 20 to pass through so that the rotatable member 20 connects with the socket outside of the cavity 18. In another embodiment in which the socket engaging portion 34 is configured to receive the protrusion of the socket, the opening 116 allows the protrusion of the socket to pass through so that the socket may be received by the socket engaging portion 34, thereby connecting the socket with the rotatable member 20 within the cavity 18.

The plate 112 also includes a plurality of small openings 118 that are disposed near the periphery of the plate 112. The openings 118 each receive a portion of the seal 114 when the seal 114 is integrally attached to the plate 112 to form the cover 110. The seal 114 is preferably insert molded onto the plate 112 in an injection molding machine, although other processes may be used to integrally form the seal 114 onto the plate 112. For example, in an embodiment, the seal 114 may be sprayed onto the plate 112. The portions of the seal 114 that extend through the openings 118 preferably form a bulb 121 on the opposite side of the plate 112 to assist in keeping the seal 114 in position on the plate 112. Also, when the seal 114 is formed, a portion 122 of the seal 114 covers a peripheral edge 124 of the plate 112. This improves the seal between the cover 110 and the cavity 18. Preferably, the seal 112 is molded from a thermoplastic elastomer, such as EVOPRENE thermoplastic elastomer. More preferably, the seal 112 is molded from a thermoplastic elastomer with a hardness of about 45 durometers.

By providing a seal 114 that is integrally attached to the plate 112 to form the cover 110, assembly of the wrench 10 is less difficult, and a better seal between the cover 110 and the head portion 14 of the body 12 may be provided. Also, if the cover 110 needs to be removed from the body 12 of the wrench 10, it is less likely that the seal 114 will be lost or damaged, as it will come off with and stay attached to the plate 112.

As shown in FIGS. 1, 3*a*, and 3*b*, an o-ring 120 may be provided to form a seal between the cover 110 and the rotatable member 20 near the opening 116 in the cover. The o-ring 120 may be received in a groove 122 provided in the front face 36 of the rotatable member 20. In an embodiment, a clip 124, shown in FIG. 3*a*, may be used to secure the cover 110 to the head portion 14 of the wrench 10. As shown, the clip 124 is generally u-shaped and includes a pair of ends 126 that may be flexed toward each other. The head portion 14 may include a groove to receive the clip 124 such that when the ends 126 of the clip 124 are flexed toward each other, the clip 124 may be received by the groove, and upon release of the ends 126, the clip 124 opens, thereby fitting snugly into the groove. This arrangement holds the cover 110 in a sealing relation with the head portion 14 so that dirt cannot enter the cavity. To remove the cover, a tool may be inserted into one or both of the openings 128 provided near the ends 126 of the clip 124 so that at least one of the ends 126 may be moved toward the other end 126. This way, the clip 124 may be removed from the groove in the head portion 14. Once the clip 124 is removed, the cover 110 may also be removed from the head portion 14 of the wrench 10.

In another embodiment, shown in FIG. 3*b*, a plurality of fasteners 130 may be used to hold the cover 110 into sealing relation with the head portion 14 of the wrench 10. The arrangement of the fasteners 130 around the circumference of the plate 112 is shown for illustrative purposes and is not intended to be limiting in any way. For example, fewer or more fasteners may be used to attach the cover 110 to the head portion 14. In the embodiment shown in FIG. 3*b*, a second plurality of openings 132 may be provided in the plate 112 so that the fasteners 130 may pass through the plate 112 and into the head portion 14.

To assemble the wrench 10, in one embodiment, the o-ring 60 is inserted into the groove 58 of the reversing member 22, and the body portion 52 of the reversing member 22 is inserted into the cavity 18 by pressing it through the opening 62 from the back side 54 of the head portion 14, so that the body portion 52 extends in the cavity 18. The spring 66 is placed into the cylindrical recess 64 of the reversing member 22, and the plunger 68 is placed over the spring 66 and into the cylindrical recess 64. The pawl 24 is connected to the reversing member 22 by placing the protrusion 96 of the pawl 24 in the protrusion receiving space 72 and the cam surface 92 of the pawl 24 in an operative relation with the spring 66, e.g. in contact with the plunger 68. While pressing the pawl 24 against the bias of the spring 66, the plurality of teeth 30 of the rotatable member 20 may be intermeshed with the plurality of teeth 90 of the pawl 24, as the rotatable member 20 is inserted into the cavity 18. The pawl 24 may then be released, and the rotatable member 20, the pawl 24, and the reversing member 22 are held in engagement with each other through the force provided by the spring 66.

The o-ring 120 is placed in the groove 122 of the rotatable member 20, and the cover 110 is placed over the cavity 18 with the integrally molded seal 114 facing the cavity 18. The clip 124 is flexed so that the ends are moved toward each other, placed in the groove in the head portion 14, and then released.

Of course, assembly of the wrench 10 does not have to be in this exact order. This order of assembly described above may be modified, as would be understood by one of ordinary skill in the art. This description is intended to provide but one example and is not intended to be limiting in any way. Of course, as the different parts of the wrench 10 are put together during assembly, small amounts of oil may be provided on the seals and between the metal parts to provide lubrication so that the parts may move smoothly. Also, the oil may help prevent rust if steel parts are used.

The foregoing illustrated embodiments have been provided solely for illustrating the structural and functional principles of the present invention and are not intended to be limiting. To the contrary, the present invention is intended to encompass all modifications, alterations, substitutions, and equivalents within the spirit and scope of the following claims.

All of the various features and mechanisms described with respect to the specific embodiments may be interchanged with the various embodiments described, or may be used with other variations or embodiments.

What is claimed is:

1. A ratchet wrench comprising:

a body with a head portion and a shaft extending from the head portion, the head portion comprising a cavity;

a rotatable member received by the cavity of the head portion and rotatable about an axis, the rotatable member having a plurality of teeth disposed around a circumferential surface thereof, and a socket engaging portion;

a reversing member pivotally mounted to the body, the reversing member being movable between a first position and a second position;

a pawl operatively connected to the reversing member and the rotatable member, the pawl comprising a plurality of teeth that are constructed and arranged to intermesh the plurality of teeth on the rotatable member, wherein the pawl is constructed and arranged to (1) prevent the rotatable member from rotating relative to the body in a first direction when the reversing mechanism is located in the first position, and (2) prevent the rotatable member from rotating relative to the body in a second direction that is opposite the first direction when the reversing mechanism is located in the second position; and a cover for covering the cavity, the cover having a plate with an opening for allowing the rotatable member to connect with a socket at the socket engaging portion, and a seal that is integrally attached to the plate so as to form a single integral piece, the plate comprising a plurality of holes for receiving portions of the seal on one side thereof.

2. A ratchet wrench according to claim 1, further comprising a retaining clip for holding the cover into sealing relation with the head portion.

3. A ratchet wrench according to claim 1, further comprising a plurality of fasteners for holding the cover into sealing relation with the head portion.

4. A ratchet wrench according to claim 1, wherein the seal comprises a thermoplastic elastomer.

5. A method according to claim 1, wherein a portion of the seal covers a portion of an inner face of the plate and another portion of the seal substantially surrounds an outer peripheral edge of the plate.

6. A ratchet wrench according to claim 1, wherein the socket engaging portion extends through the opening in the cover.

7. A ratchet wrench according to claim 1, wherein the reversing member comprises a fork with a protrusion receiving space and the pawl comprises a protrusion slidably received in the protrusion receiving space of the fork, and wherein the protrusion and protrusion receiving space are configured to maintain intermeshing of the teeth of the pawl with the teeth of the rotatable member as the reversing member moves between the first position and the second position.

8. A ratchet wrench according to claim 1, wherein the plurality of teeth on the pawl have substantially the same pitch as the plurality of teeth on the rotatable member.

9. A method for assembling a ratchet wrench comprising:

inserting a portion of a reversing member into a cavity of a head portion of a body of the ratchet wrench, the reversing member comprising a protrusion receiving space;

operatively connecting a pawl to the reversing member by placing a protrusion of the pawl in the protrusion receiving space;

intermeshing a plurality of teeth of a rotatable member with a plurality of teeth of the pawl;

inserting at least a portion of the rotatable member into the cavity;

providing a cover having a seal that is integrally attached to the cover so as to form a single integral piece, the cover comprising a plurality of holes for receiving portions of said seal on one side thereof and an opening for allowing the rotatable member to connect with a socket; and mounting the cover to the head portion to close the cavity and seal the cover with the head portion.

10. A method according to claim 9, wherein the seal comprises a thermoplastic elastomer.

11. A method according to claim 9, wherein the reversing member further comprises an o-ring that provides a seal between the reversing member and the head portion when the portion of the reversing member is inserted into the cavity.

12. A method according to claim 9, wherein the rotatable member further comprises an o-ring that provides a seal between the cover and the rotatable member when the cover is mounted to the head portion.

13. A method according to claim 9, wherein the seal is insert molded onto the plate.

14. A ratchet wrench according to claim 1, wherein the seal is sprayed onto the plate.

* * * * *